US010247062B2

(12) United States Patent
Sugiura et al.

(10) Patent No.: US 10,247,062 B2
(45) Date of Patent: Apr. 2, 2019

(54) VARIABLE VALVE MECHANISM OF INTERNAL COMBUSTION ENGINE

(71) Applicant: OTICS CORPORATION, Nishio-shi (JP)

(72) Inventors: Masatoshi Sugiura, Nishio (JP); Naoki Hiramatsu, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 39 days.

(21) Appl. No.: 15/469,426

(22) Filed: Mar. 24, 2017

(65) Prior Publication Data

US 2017/0292416 A1 Oct. 12, 2017

(30) Foreign Application Priority Data

Apr. 11, 2016 (JP) ..... 2016-079088

(51) Int. Cl.

*F01L 1/34* (2006.01)
*F01L 13/00* (2006.01)
*F01L 1/18* (2006.01)

(52) U.S. Cl.

CPC ..... *F01L 13/0026* (2013.01); *F01L 1/18* (2013.01); *F01L 1/185* (2013.01); *F01L 13/0005* (2013.01); *F01L 13/0036* (2013.01); *F01L 2001/186* (2013.01); *F01L 2105/00* (2013.01)

(58) Field of Classification Search

CPC ..... F01L 1/18; F01L 1/185; F01L 13/0026; F01L 13/0005; F01L 13/0036; F01L 2001/186; F01L 2105/00

See application file for complete search history.

(56) References Cited

U.S. PATENT DOCUMENTS

2015/0285110 A1 10/2015 Sugiura et al.

FOREIGN PATENT DOCUMENTS

| | | | |
|---|---|---|---|
| EP | 0 420 159 | A1 | 4/1991 |
| EP | 0 588 336 | A1 | 3/1994 |
| EP | 0 671 550 | A1 | 9/1995 |
| EP | 0 687 804 | A1 | 12/1995 |
| FR | 2 980 518 | A1 | 3/2013 |
| JP | 2009-068382 | A | 4/2009 |
| JP | 2015-200224 | A | 11/2015 |

OTHER PUBLICATIONS

Extended European Search Report dated Jul. 28, 2017 in European Application No. 17157308.2.

*Primary Examiner* — Zelalem Eshete
(74) *Attorney, Agent, or Firm* — McGinn IP Law Group, PLLC.

(57) ABSTRACT

A variable valve mechanism includes a first cam and a second cam, a main arm that drives a valve when swinging, a first sub arm that swings when pressed by the first cam, a second sub arm that swings when pressed by the second cam, and a switch device. The switch device includes a first switch pin that moves between a first coupled position between the main arm and the first sub arm and a first uncoupled position, and a second switch pin that moves between a second coupled position between the main arm and the second sub arm and a second uncoupled position. Both switch pins are arranged so as to be displaced from each other in positions where these switch pins do not overlap at least during a base circle phase in which base circles of both cams act.

19 Claims, 12 Drawing Sheets

LARGE-LIFT MODE
BOTH-SIDES-COUPLED STATE

SMALL-LIFT MODE
ONE-SIDE-COUPLED STATE

NO-LIFT MODE
UNCOUPLED STATE

VARIABLE VALVE MECHANISM OF INTERNAL COMBUSTION ENGINE

TECHNICAL FIELD

The present invention relates to a variable valve mechanism that drives a valve of an internal combustion engine and switches the drive state of the valve in accordance with the operating condition of the internal combustion engine.

BACKGROUND ART

Examples of a variable valve mechanism include a variable valve mechanism 90 developed by the applicant of the present invention and illustrated in FIG. 11 and FIGS. 12A and 12B (Patent Document 1). This variable valve mechanism 90 includes a main arm 92 that is driven by a small-lift cam 91*a* to drive a valve 7, a first sub arm 93 that is driven by a middle-lift cam 91*b* to swing, and a second sub arm 94 that is driven by a large-lift cam 91*c* to swing. The respective sub arms 93 and 94 are each coupled to and uncoupled from the main arm 92, whereby three-stage switching is achieved.

CITATION LIST

Patent Document

[Patent Document 1] Japanese Patent Application Publication No. 2015-200224

SUMMARY OF INVENTION

Technical Problem

However, in the variable valve mechanism 90, as depicted in FIG. 12B, a first switch pin 95 that couples and uncouples the first sub arm 93 to and from the main arm 92 and a second switch pin 96 that couples and uncouples the second sub arm 94 to and from the main arm 92 are aligned in the arm-width direction. Because of this alignment, the first sub arm 93 needs to be provided on one side in the arm-width direction with respect to the main arm 92, and the second sub arm 94 needs to be provided on the other side in the arm-width direction, which reduces flexibility of positional relations among the three arms 92, 93, and 94.

The two switch pins 95 and 96 are aligned in the arm-width direction, which results in an increased size of the switch mechanism in the arm-width direction. This increases the sizes of the three arms 92, 93, and 94 in the arm-width direction.

Because the first sub arm 93 is provided on the one side in the arm-width direction with respect to the main arm 92 and the second sub arm 94 is provided on the other side in the arm-width direction, in at least some drive states in the three-stage switching, force is unevenly applied in the arm-width direction. Thus, when the main arm 92 is supported by a pivot 98, the balance in the arm-width direction deteriorates. This requires a swing guide 99 that guides the main arm 92 in the swing direction.

In view of this, it is a first object of the present invention to increase flexibility of positional relations among three arms. In addition, it is a second object of the present invention to reduce the size of the three arms in the arm-width direction. Furthermore, it is a third object of the present invention to improve a balance of the three arms in the arm-width direction, thereby enabling the main arm to be stably supported by a pivot even without a swing guide described in the conventional example.

Solution to Problem

In order to achieve the first object (to increase flexibility of positional relations), a variable valve mechanism of the present invention is configured as follows. The variable valve mechanism includes: a first cam and a second cam that have different profiles; a main arm that drives a valve when swinging; a first sub arm that swings when pressed by the first cam; a second sub arm that swings when pressed by the second cam; and a switch device. The switch device includes: a first switch pin that is provided so as to be movable between a first coupled position where the first switch pin extends across an interface between the main arm and the first sub arm and a first uncoupled position where the first switch pin does not extend across this interface; and a second switch pin that is provided so as to be movable between a second coupled position where the second switch pin extends across an interface between the main arm and the second sub arm and a second uncoupled position where the second switch pin does not extend across this interface. In side view when seen in an arm-width direction that is a longitudinal direction of a swing axis of the main arm, both switch pins are arranged so as to be displaced from each other in positions where these switch pins do not overlap at least during a base circle phase where base circles of both cams act.

Examples of specific positions of both switch pins include, but not limited to, the following form. The first sub arm includes a roller rotatably mounted on the first sub arm and configured to be pressed by the first cam. One of the switch pins is arranged such that at least part of the one of the switch pins is positioned in an area between the swing axis of the main arm and the roller in side view at least during the base circle phase. The other of the switch pins is arranged such that the whole part of the other of the switch pins is positioned above the swing axis of the main arm in side view at least during the base circle phase.

The positions of both sub arms are, but not limited to, preferably positions in the following form in order to achieve the second object (to reduce the size in the arm-width direction). The first sub arm and the second sub arm are arranged so as to be vertically displaced from each other in positions where these sub arms overlap in plan view at least during the base circle phase.

Although the form of the three arms is not limited to a particular one, the following form is preferable in order to achieve the third object (to be supported by a pivot without a swing guide). The main arm is swingably supported by a pivot. The first sub arm and the second sub arm are outer arms each of which includes a one-side portion disposed on one side in the arm-width direction with respect to the main arm and an other-side portion disposed on the other side in the arm-width direction with respect to the main arm.

Advantageous Effects of Invention

According to the present invention, both switch pins are arranged so as to be displaced from each other in positions where these switch pins do not overlap at least during the base circle phase in side view when seen in the arm-width direction. Unlike the conventional example in which both switch pins are aligned in the arm-width direction during the base circle phase, this arrangement eliminates the constraint of positional relations that the first sub arm needs to be provided on one side in the arm-width direction with respect to the main arm, and the second sub arm needs to be provided on the other side in the arm-width direction. Thus, the flexibility of positional relations among the three arms can be increased.

Accordingly, for example, as in the form for achieving the second object, the first sub arm and the second sub arm can be arranged so as to be vertically displaced from each other in positions where these sub arms overlap in plan view, whereby space can be reduced in the arm-width direction. Thus, compared with the case in which three arms are aligned in the arm-width direction, the sizes of the three arms can be reduced in the arm-width direction.

For example, as in the form for achieving the third object, the first sub arm and the second sub arm can be used as outer arms, whereby the balance of the three arms in the arm-width direction can be improved. Consequently, without a swing guide described in the conventional example, the main arm can be stably supported by the pivot.

DESCRIPTION OF EMBODIMENTS

Figure 1:
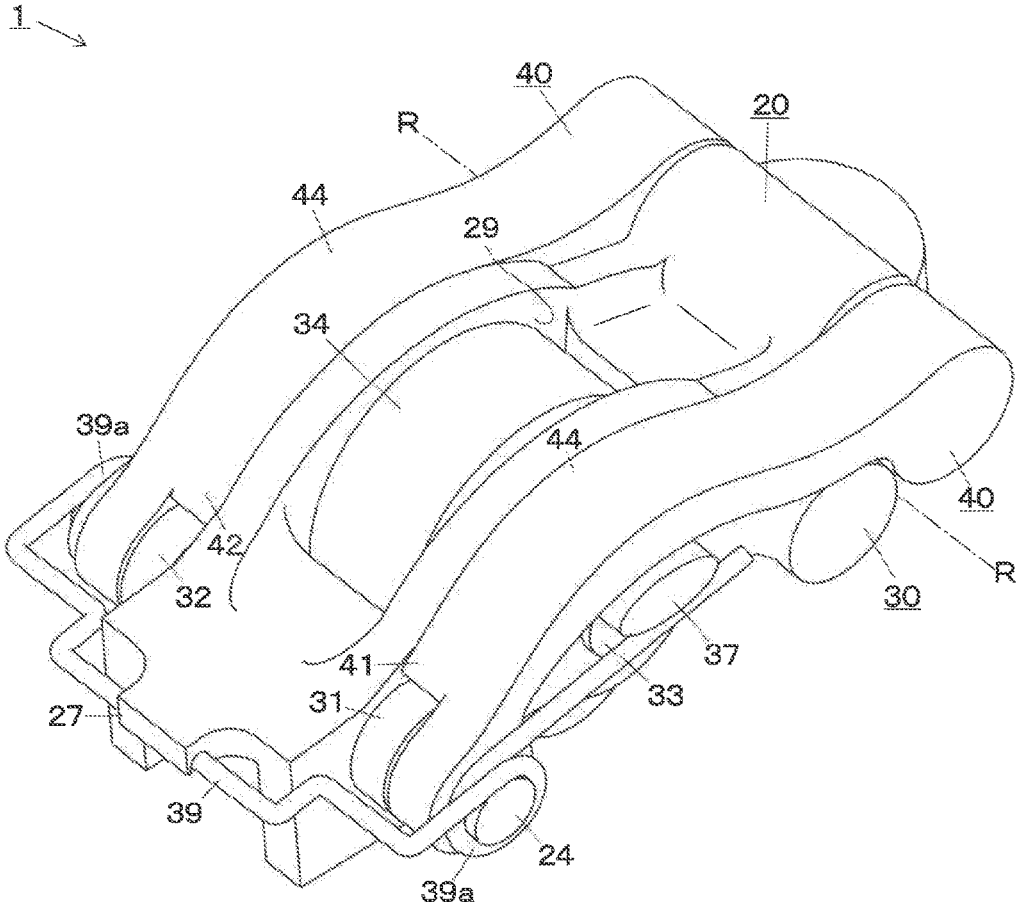
FIG. 1 is a perspective view illustrating a main arm and two sub arms of a variable valve mechanism of a first embodiment.

A switch device may switch in two stages, for example, between a first one-side-coupled state in which a first switch pin is placed in a first coupled position and a second switch pin is placed in a second uncoupled position and a second one-side-coupled state in which the first switch pin is placed in a first uncoupled position and the second switch pin is placed in a second coupled position. However, from the viewpoint of improving fuel efficiency and engine performance, the switch device preferably switches in three stages.

Examples of a form of this three-stage switching include, but not limited to, the following forms.

[1] The switch device switches a drive state of the valve among a both-sides-coupled state in which the first switch pin is placed in the first coupled position and the second switch pin is placed in the second coupled position, a one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position. According to this form, three-stage switching can be achieved with a simple structure.

[2] The switch device switches a drive state of the valve among a first one-side-coupled state in which the first switch pin is placed in the first coupled position and the second switch pin is placed in the second uncoupled position, a second one-side-coupled state in which the first switch pin is placed in the first uncoupled position and the second switch pin is placed in the second coupled position, and the uncoupled state in which the first switch pin is placed in the first uncoupled position and the second switch pin is placed in the second uncoupled position. According to this form, switching can be performed in a form in which the lift curve in the first one-side-coupled state and the lift curve in the second one-side-coupled state intersect.

Although the form of the switch device is not limited to a particular one, it is preferable that the switch device is configured as described below in that both switch pins can be controlled by oil pressure of one hydraulic system. The switch device includes a hydraulic mechanism that presses both switch pins with oil pressure of one hydraulic system, a first spring that biases the first switch pin in a direction opposite to a pressing direction of the oil pressure, and a second spring that biases the second switch pin in the direction opposite to the pressing direction of the oil pressure. The hydraulic mechanism switches a drive state of the valve into a first state by adjusting the oil pressure to a high pressure with which a force pressing the first switch pin becomes greater than a biasing force of the first spring and a force pressing the second switch pin becomes greater than a biasing force of the second spring. The hydraulic mechanism switches the drive state of the valve into a second state by adjusting the oil pressure to an intermediate pressure with which the force pressing the first switch pin becomes smaller than the biasing force of the first spring and the force pressing the second switch pin becomes greater than the biasing force of the second spring. The hydraulic mechanism switches the drive state of the valve into a third state by adjusting the oil pressure to a low pressure with which the force pressing the first switch pin becomes smaller than the biasing force of the first spring and the force pressing the second switch pin becomes smaller than the biasing force of the second spring.

Examples of a form of the first to third states include: but not limited to, a form in which the first state is any one of the both-sides-coupled state, the one-side-coupled state, and the uncoupled state described above in [1], the second state is another one thereof, and the third state is the remaining one; and a form in which the first state is any one of the first one-side-coupled state, the second one-side-coupled state, and the uncoupled state described above in [2], the second state is another one thereof, and the third state is the remaining one.

Examples of a form of a structure for switching the drive state into the second state by adjusting the oil pressure to the intermediate pressure include, but not limited to, the following forms.

[a] A spring constant of the first spring is larger than that of the second spring.

[b] An area of the second switch pin that receives the oil pressure is larger than that of the first switch pin.

Although the form of a first sub arm is not limited to a particular one, the following form is preferable in that the first sub arm can be evenly pressed in the arm-width direction by a first cam alone. The main arm has a space in its intermediate portion in the arm-width direction. On each of side surfaces of the main arm on both sides in the arm-width direction, an elongated hole extending in a swing direction of the first sub arm with respect to the main arm is formed in a manner penetrating the main arm to reach the space. The first sub arm includes: a one-side portion that is disposed on one side in the arm-width direction with respect to the main arm; an other-side portion that is disposed on the other side in the arm-width direction with respect to the main arm; a roller shaft that passes through the elongated holes and the space of the main arm to extend from the one-side portion to the other-side portion; and a roller that is pivotally supported by a part of the roller shaft located in the space. The roller is pressed by the first cam.

In the form described above in [1], the structure for causing the first sub arm to idle in the one-side-coupled state and causing both sub arms to idle in the uncoupled state is not limited to a particular structure. However, the following form is preferable in that both sub arms can be caused to idle by one lost motion spring. The second sub arm is interposed between the first sub arm and a second cam. The variable valve mechanism includes a lost motion spring that biases the first sub arm toward the first cam in the one-side-coupled state, and biases the first sub arm toward the first cam and also biases the second sub arm toward the second cam via the first sub arm in the uncoupled state.

First Embodiment

Embodiments of the present invention will now be described. The present invention is not limited to the embodiments, and the configuration and shape of each part may be modified as desired without departing from the spirit and scope of the invention.

A variable valve mechanism 1 of a first embodiment illustrated in FIG. 1 to FIG. 8 includes a camshaft 10, a main arm 20, a first sub arm 30, a second sub arm 40, and a switch device 50. Hereinafter, the longitudinal direction of a swing axis R of the main arm 20 is called "arm-width direction", and the time when seen in the arm-width direction is called "in side view".

[Camshaft 10]

Figure 5A:
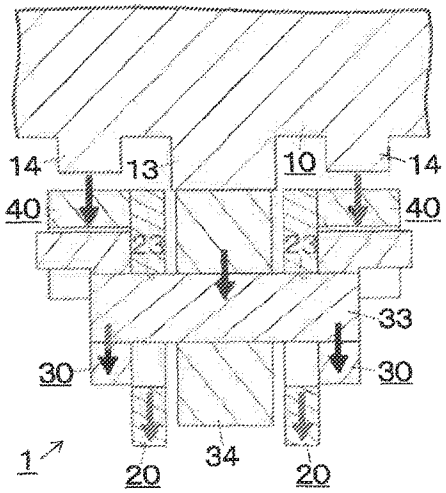
FIG. 5A is a front sectional view (taken along line Va-Va in FIG. 6) illustrating a nose phase of the variable valve mechanism in the large-lift mode.
Figure 5B:
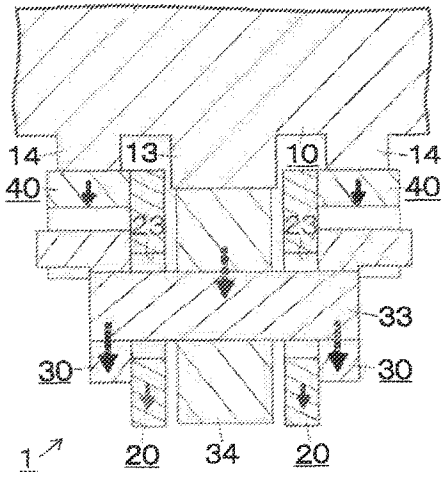
FIG. 5B is a front sectional view (taken along line Vb-Vb in FIG. 7) illustrating a nose phase thereof in the small-lift mode.
Figure 5C:
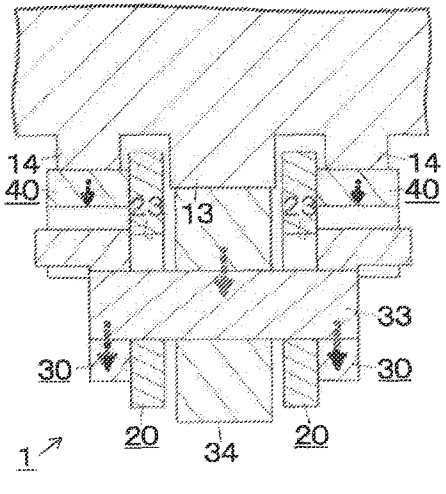
FIG. 5C is a sectional view (taken along line Vc-Vc in FIG. 8) illustrating a nose phase thereof in the no-lift mode.

The camshaft 10 depicted in FIG. 2, FIG. 3, FIGS. 5A, 5B, 5C, etc., rotates once every time an internal combustion engine rotates twice. On the camshaft 10, one first cam 13 (large-lift cam) and two second cams 14 (small-lift cams) are formed in a protruding manner. Specifically, as depicted in FIGS. 5A, 5B, 5C, etc., one of the second cams 14 is formed on one side in the arm-width direction with respect to the first cam 13, and the other of the second cams 14 is formed on the other side in the arm-width direction with respect to the first cam 13. The first and second cams 13 and 14 have base circles 13*a* and 14*a* and noses 13*b* and 14*b* that protrude from the base circles, respectively. The nose 13*b* of the first cam 13 (large-lift cam) has an action angle and a lift amount that are larger than those of the noses 14*b* of the second cams 14 (small-lift cams).

In the following description and in the above "BRIEF DESCRIPTION OF THE DRAWINGS", the time when the base circles 13*a* and 14*a* of both cams act, that is, the time when the base circle 13*a* of the first cam acts on the first sub arm 30 and the base circles 14*a* of the second cams act on the second sub arm 40 is called "base circle phase". The time when the noses 13*b* and 14*b* of both cams act, that is, the time when the nose 13*b* of the first cam acts on the first sub arm 30 and the noses 14*b* of the second cams act on the second sub arm 40 is called "nose phase".

[Main Arm 20]

Figure 2:
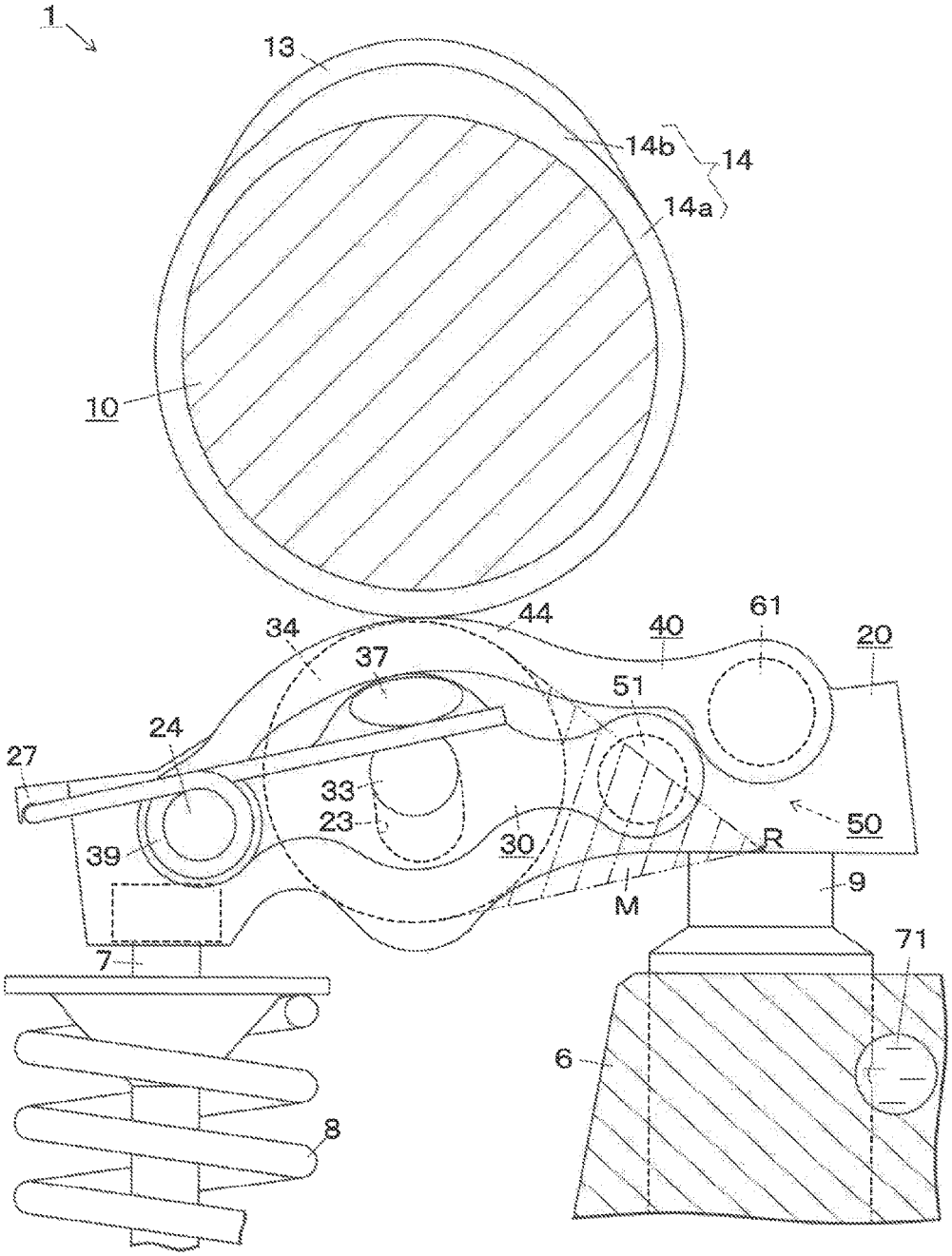
FIG. 2 is a side view illustrating the variable valve mechanism during a base circle phase.
Figure 3:
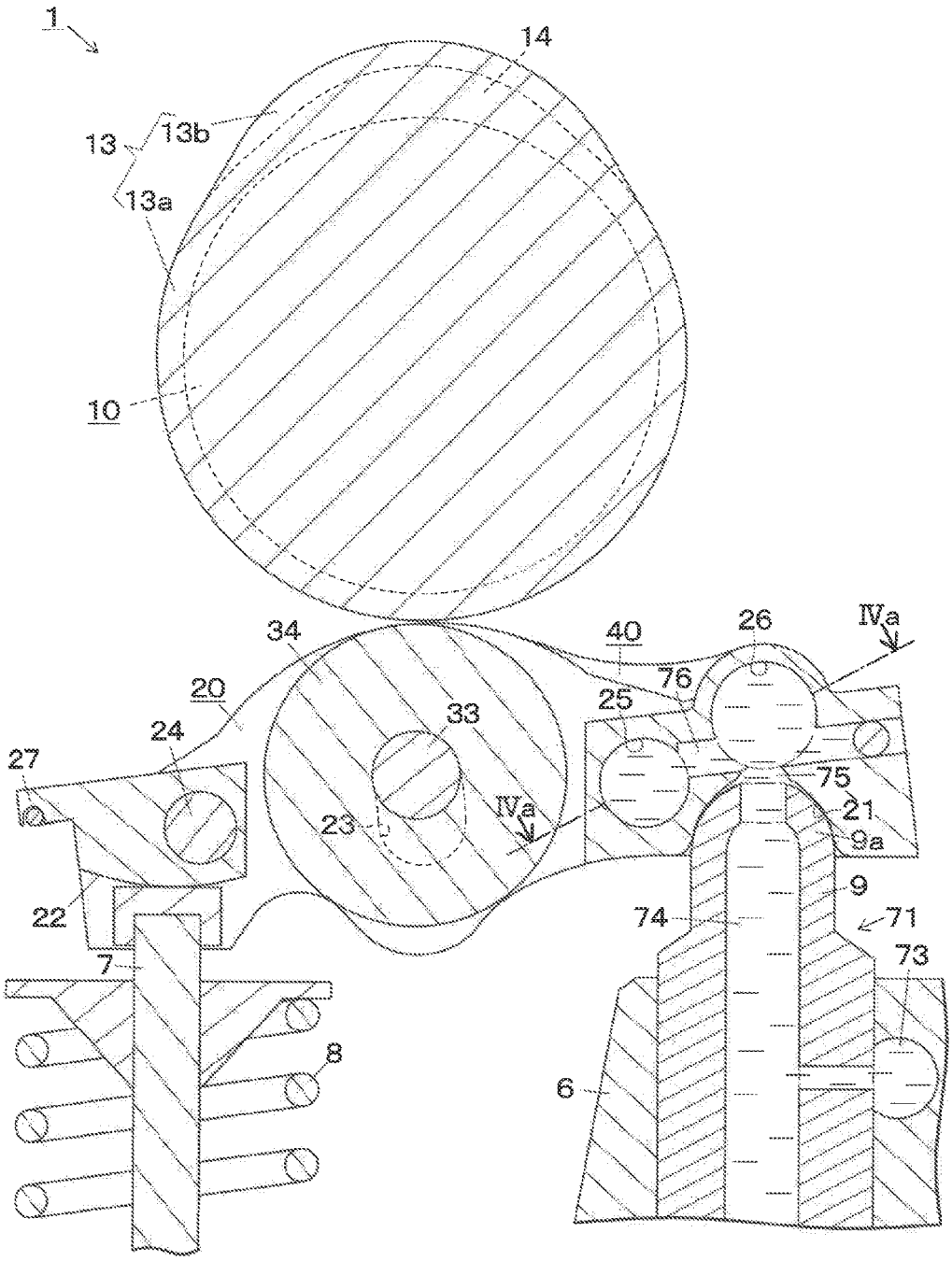
FIG. 3 is a side sectional view (taken along line III-III in FIG. 4A) illustrating the variable valve mechanism during the base circle phase.

As depicted in FIG. 3, etc., the main arm 20 has a hemispherical recessed portion 21 formed on a lower surface of a rear portion thereof. The hemispherical recessed portion 21 is mounted on a hemisphere portion 9*a* formed on an upper end of a pivot 9, and thus the main arm 20 is swingably supported by the pivot 9. The straight line passing through the spherical center of the hemisphere portion 9*a* is the swing axis R of the main arm 20. The main arm 20 has, on a front-end portion thereof, a pressing surface 22 that is in contact with the stem end of a valve 7, and drives the valve 7 with the pressing surface 22 when swinging. As depicted in FIG. 1, etc., to a front portion of the main arm 20, a support shaft 24 is attached. The support shaft 24 penetrates a front portion of the main arm 20 in the arm-width direction to protrude from the front portion of the main arm 20 to both sides in the arm-width direction. On a front-end portion of the main arm 20, a locking projection 27 is formed in a manner protruding forward. As depicted in FIG. 1, etc., in an intermediate portion of the main arm 20 in the arm-width direction, a space 29 is formed. As depicted in FIG. 2, etc., on each of side surfaces of the main arm 20 on both sides in the arm-width direction, an elongated hole 23 that penetrates the main arm to reach the space 29 is formed. The elongated hole 23 extends in the relative swing direction of the first sub arm 30 with respect to the main arm 20.

As depicted in FIG. 3, FIGS. 4A, 4B, 4C, etc., on a rear portion of the main arm 20, a first pin hole 25 and a second pin hole 26 are formed in a manner penetrating the main arm in the arm-width direction. As depicted in FIG. 2, etc., the first pin hole 25 and a first switch pin 51 inserted thereinto are arranged such that part thereof is positioned in an area M between the swing axis R of the main arm 20 and a roller 34 of the first sub arm 30 in side view at least during the base circle phase. The second pin hole 26 and a second switch pin 61 inserted thereinto are arranged such that the whole part thereof is always positioned above the swing axis R of the main arm 20 in side view. At all times, the first and second switch pins 51 and 61 do not overlap each other in side view.

[First Sub Arm 30]

Figure 4A:
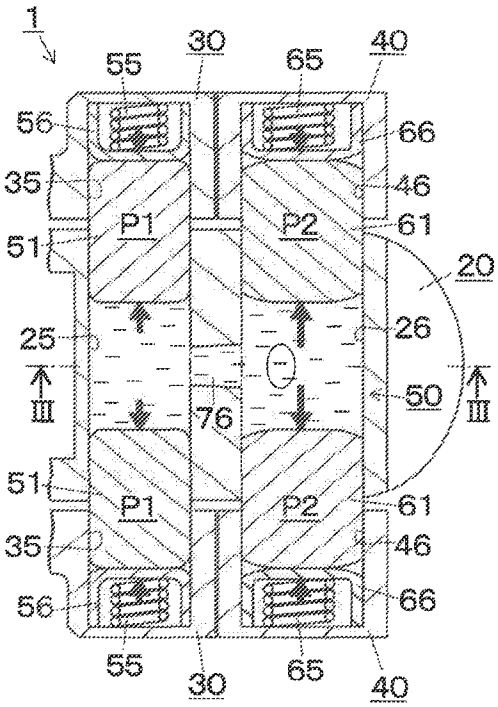
FIG. 4A is a sectional view (taken along line IVa-IVa in FIG. 3) illustrating a state of the variable valve mechanism in the base circle phase that is switched to a large-lift mode (both-sides-coupled state)
Figure 4B:
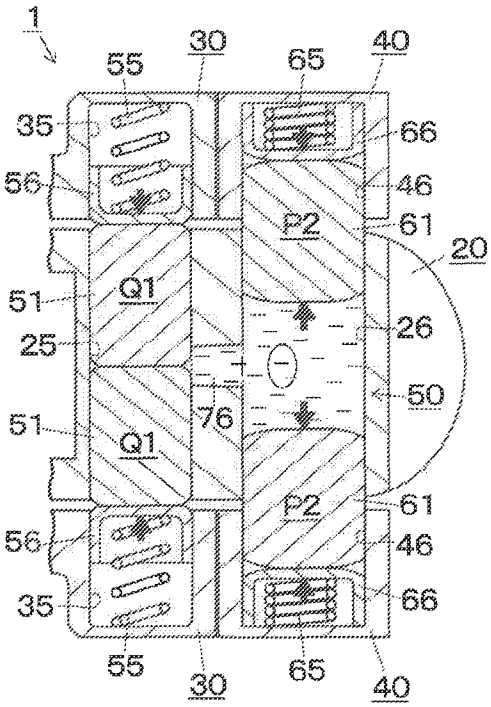
FIG. 4B is a sectional view illustrating the state that is switched into a small-lift mode (one-side-coupled state)
Figure 4C:
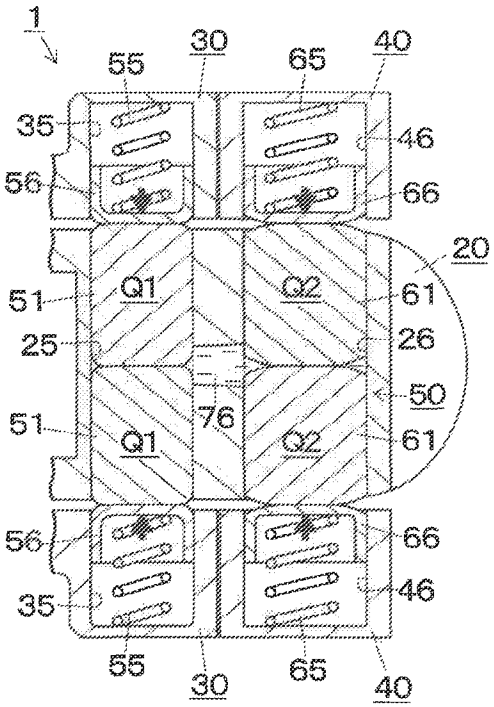
FIG. 4C is a sectional view illustrating the state that is switched into a no-lift mode (uncoupled state)
Figure 6:
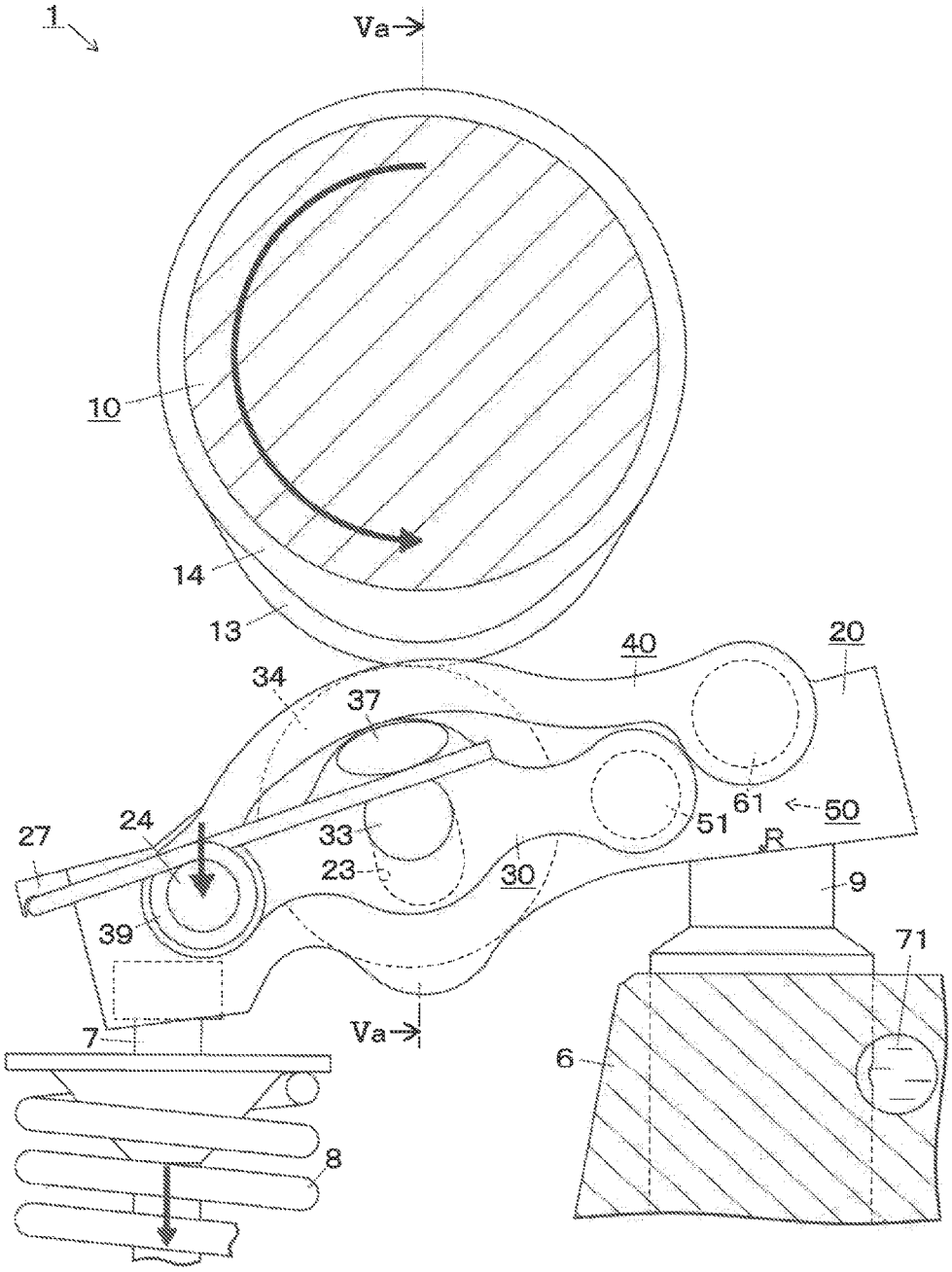
FIG. 6 is a side view illustrating the nose phase of the variable valve mechanism in the large-lift mode.
Figure 7:
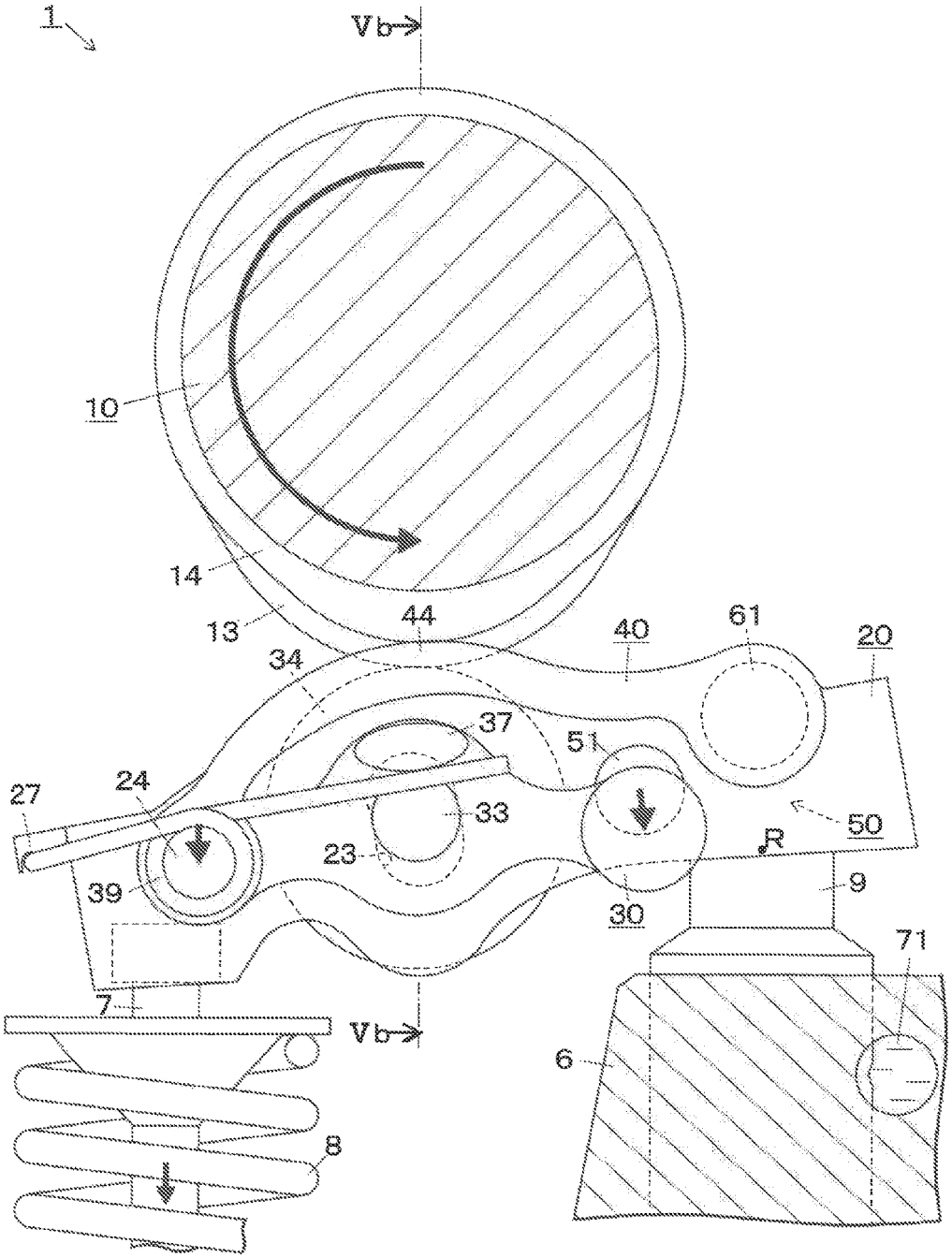
FIG. 7 is a side view illustrating the nose phase of the variable valve mechanism in the small-lift mode.
Figure 8:
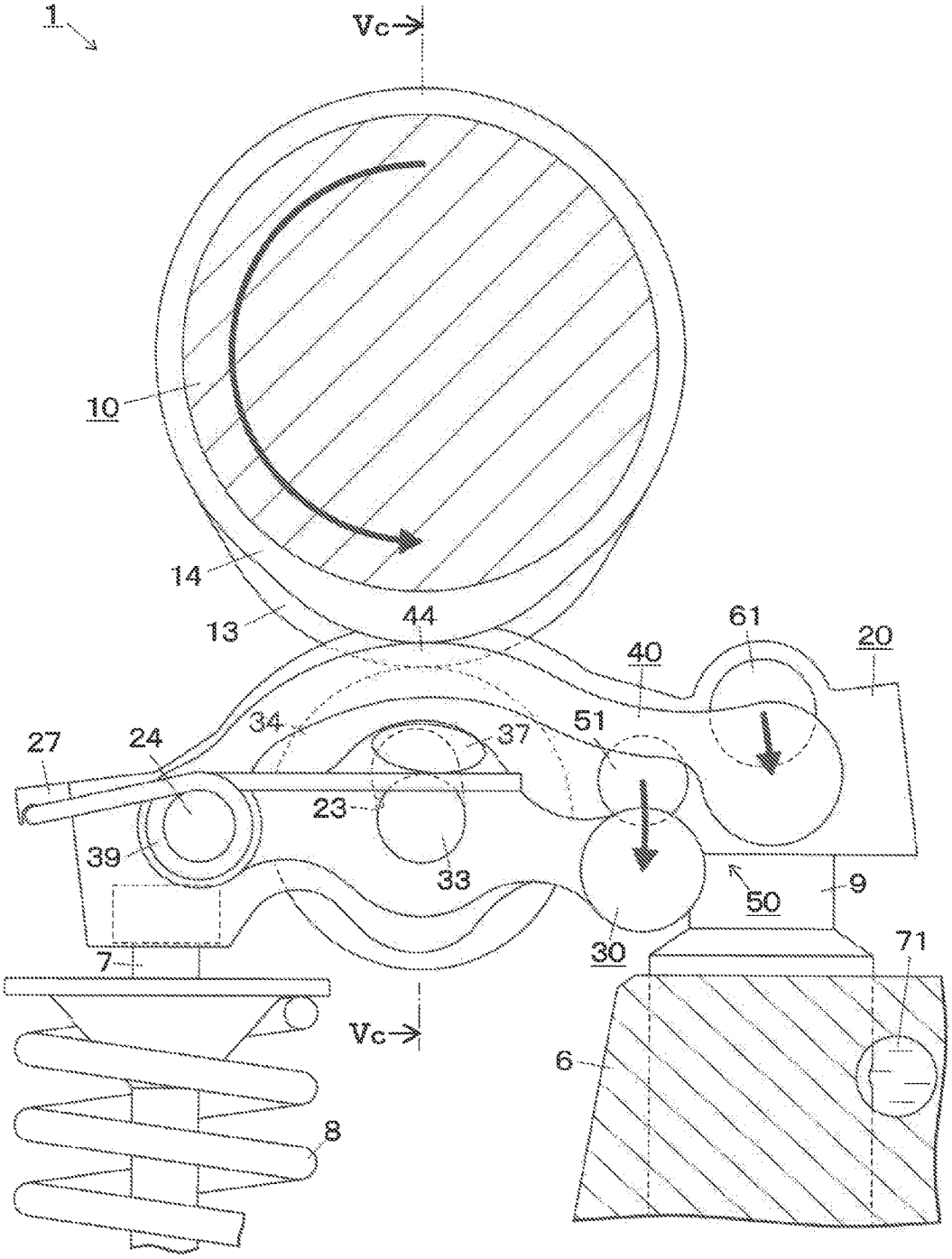
FIG. 8 is a side view illustrating the nose phase of the variable valve mechanism in the no-lift mode.

As depicted in FIG. 1, etc., the first sub arm 30 is an outer arm that includes a one-side portion 31 disposed on the one side in the arm-width direction with respect to the main arm 20 and an other-side portion 32 disposed on the other side in the arm-width direction with respect to the main arm 20. A front-end portion of the one-side portion 31 is pivotally supported by a portion of the support shaft 24 that protrudes to the one side in the arm-width direction. A front-end portion of the other-side portion 32 is pivotally supported by a portion of the support shaft 24 that protrudes to the other side in the arm-width direction. Thus, the first sub arm 30 is supported so as to be able to relatively swing about the front-end portions with respect to the main arm 20. In a longitudinally intermediate portion of the first sub arm 30, a roller shaft 33 is disposed that passes through the elongated holes 23 and the space 29 of the main arm 20 to extend from the one-side portion 31 to the other-side portion 32. The roller 34 that is in contact with the first cam 13 is rotatably pivotally supported by a part of the roller shaft 33 located in the space 29. As depicted in FIG. 6 to FIG. 8, etc., the roller 34 is pressed by the first cam 13 (large-lift cam), whereby the first sub arm 30 is swung. In longitudinally intermediate portions of the first sub arm 30, locking projections 37 are formed that protrude to both sides in the arm-width direction. As depicted in FIGS. 4A, 4B, 4C, etc., in each of rear portions of the one-side portion 31 and the other-side portion 32, a pin hole 35 that is open inward in the arm-width direction (to the main arm 20 side) is formed. The pin hole 35 communicates with the first pin hole 25 of the main arm 20 during the base circle phase.

As depicted in FIG. 1, etc., to the first sub arm 30, a lost motion spring 39 is attached. The lost motion spring 39 has a U-shape that is open rearward in plan view and has two coil portions 39*a*. One of the coil portions 39*a* is fitted onto a portion of the support shaft 24 that protrudes to the one side in the arm-width direction, and the other of the coil portions 39*a* is fitted onto a portion of the support shaft 24 that protrudes to the other side in the arm-width direction. A central portion of the front-end portion of the lost motion spring 39 is in contact with the locking projection 27 of the main arm 20 from below. Two rear end portions of the lost motion spring 39 are each in contact with two locking projections 37 of the first sub arm 30 from below.

[Second Sub Arm 40]

As depicted in FIG. 1, etc., the second sub arm 40 is an outer arm that includes a one-side portion 41 disposed on the one side in the arm-width direction with respect to the main arm 20 and an other-side portion 42 disposed on the other side in the arm-width direction with respect to the main arm 20. A front-end portion of the one-side portion 41 is pivotally supported by a portion of the support shaft 24 that protrudes to the one side in the arm-width direction in a manner aligned with the one-side portion of the first sub arm 30. A front-end portion of the other-side portion 42 is pivotally supported by a portion of the support shaft 24 that protrudes to the other side in the arm-width direction in a manner aligned with the other-side portion 32 of the first sub arm 30. Thus, the second sub arm 40 is supported so as to be able to relatively swing about the front-end portions with respect to the main arm 20. The one-side portion 41 is interposed between the one-side portion 31 of the first sub arm 30 and one of the second cams 14. The other-side portion 42 is interposed between the other-side portion 32 of the first sub arm 30 and the other of the second cams 14. Specifically, the one-side portion 41 is disposed in a position overlapping the one-side portion 31 of the first sub arm 30 in plan view in a manner displaced upward therefrom. The other-side portion 42 is disposed in a position overlapping the other-side portion 32 of the first sub arm 30 in plan view in a manner displaced upward therefrom. On respective upper surfaces of the one-side portion 41 and the other-side portion 42, slippers 44 that are sliding-contact with the second cams 14 are each formed. As depicted in FIG. 7, FIG. 8, etc., the respective slippers 44 are pressed by the corresponding second cams 14, whereby the one-side portion 41 and the other-side portion 42 (second sub arm 40) are swung. As depicted in FIGS. 4A, 4B, 4C, etc., in each of rear portions of the one-side portion 41 and the other-side portion 42, a pin hole 46 that is open inward in the arm-width direction (to the main arm 20 side) is formed. The pin hole 46 communicates with the second pin hole 26 of the main arm 20 during the base circle phase.

[Switch Device 50]

As depicted in FIGS. 4A, 4B, 4C, etc., the switch device 50 includes the first and second switch pins 51 and 61, first and second springs 55 and 65, and a hydraulic mechanism 71.

The first switch pin 51 is provided in two pieces, and both are arranged in the first pin hole 25 of the main arm. Each first switch pin 51 is configured to be movable between a first coupled position P1 and a first uncoupled position Q1. The first coupled position P1 is located on the relatively outer side in the arm-width direction, and when being placed in this position P1, the first switch pin 51 extends across an interface between the first pin hole 25 and the corresponding pin hole 35 of the first sub arm. The first uncoupled position Q1 is located on the relatively inner side in the arm-width direction, and when being placed in this position Q1, the first switch pin 51 does not extend across this interface (is withdrawn in the first pin hole 25). When being placed in the first coupled position P1, the first switch pin 51 couples the first sub arm 30 to the main arm 20 in a relatively non-swingable manner. When the first switch pin 51 is placed in the first uncoupled position Q1, this coupling is released.

The second switch pin 61 is provided in two pieces, and both are arranged in the second pin hole 26 of the main arm. Each second switch pin 61 is configured to be movable between a second coupled position P2 and a second uncoupled position Q2. The second coupled position P2 is located on the relatively outer side in the arm-width direction, and when being placed in this position P2, the second switch pin 61 extends across an interface between the second pin hole 26 and the corresponding pin hole 46 of the second sub arm. The second uncoupled position Q2 is located on the relatively inner side in the arm-width direction, and when being placed in this position Q2, the second switch pin 61 does not extend across this interface (is withdrawn in the second pin hole 26). When being placed in the second coupled position P2, the second switch pin 61 couples the second sub arm 40 to the main arm 20 in a relatively non-swingable manner. When the second switch pin 61 is placed in the second uncoupled position Q2, this coupling is released. The diameter of the second switch pin 61 is larger than the diameter of the first switch pin 51. Accordingly, the area of an end surface of the second switch pin 61 is larger than the area of an end surface of the first switch pin 51. Thus, when the same oil pressure is applied, the force received by the second switch pin 61 is greater than the force received by the first switch pin 51 as indicated by lengths of arrows in FIG. 4A, etc.

The first spring 55 is disposed between the bottom surface of each pin hole 35 of the first sub arm and the corresponding first switch pin 51 and, via a first intervening pin 56, biases the first switch pin 51 toward the corresponding first uncoupled position Q1 on the inner side in the arm-width direction.

The second spring 65 is disposed between the bottom surface of each pin hole 46 of the second sub arm and the corresponding second switch pin 61 and, via a second intervening pin 66, biases the second switch pin 61 toward the corresponding second uncoupled position Q2 on the inner side in the arm-width direction. In the present embodiment, the spring constant of the second spring 65 is the same as the spring constant of the first spring 55.

The hydraulic mechanism 71 includes a cylinder-head oil passage 73, a pivot oil passage 74, and first and second oil passages 75 and 76 in the main arm 20. The cylinder-head oil passage 73 is formed in a cylinder head 6. The pivot oil passage 74 is formed in the pivot 9, and extends from the cylinder-head oil passage 73 to the upper end of the hemisphere portion 9*a*. The first oil passage 75 extends from the pivot oil passage 74 to the first pinhole 25. The second oil passage 76 extends from the first pin hole 25 to the second pin hole 26. Thus, the first pin hole 25 and the second pin hole 26 are filled with oil of the same hydraulic system, and receive substantially the same oil pressure.

Figure 5D:
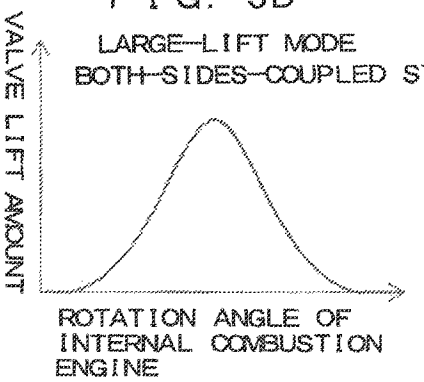
FIG. 5D is a graph illustrating a lift curve in the large-lift mode.

By adjusting the oil pressure of this hydraulic system to a high pressure as depicted in FIG. 4A, the first switch pin 51 is placed in the first coupled position P1 on the outer side in the arm-width direction, and the second switch pin 61 is also placed in the second coupled position P2 on the outer side in the arm-width direction. The "high pressure" herein means such an oil pressure that the force of oil pressure pressing the first switch pin 51 in the first pin hole 25 is greater than the biasing force of the first spring 55 and that the force of oil pressure pressing the second switch pin 61 in the second pin hole 26 is also greater than the biasing force of the second spring 65. By this adjustment, as depicted in FIGS. 5A and 5D and FIG. 6, the drive state of the valve is switched into a large-lift mode (both-sides-coupled state) in which the three arms 20, 30, and 40 swing about the swing axis R in accordance with the profile of the first cam 13 (large-lift cam) to drive the valve 7.

Figure 5E:
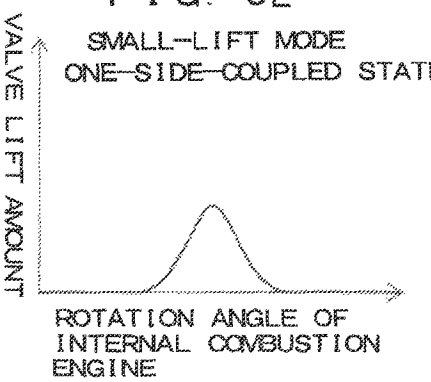
FIG. 5E is a graph illustrating a lift curve in the small-lift mode.

By adjusting the oil pressure of the hydraulic system to an intermediate pressure as depicted in FIG. 4B, the first switch pin 51 is placed in the first uncoupled position Q1 on the inner side in the arm-width direction, and the second switch pin 61 is placed in the second coupled position P2 on the outer side in the arm-width direction. The "intermediate pressure" herein means such an oil pressure that the force of oil pressure pressing the first switch pin 51 in the first pin hole 25 is smaller than the biasing force of the first spring 55 and that the force of oil pressure pressing the second switch pin 61 in the second pin hole 26 is greater than the biasing force of the second spring 65. By this adjustment, as depicted in FIGS. 5B and 5E and FIG. 7, the drive state is switched into a small-lift mode (one-side-coupled state) in which the main arm 20 and the second sub arm 40 swing about the swing axis R in accordance with the profile of the second cams 14 (small-lift cams) to drive the valve 7. At this time, the lost motion spring 39 biases the first sub arm 30 toward the first cam 13 (large-lift cam). Thus, the first sub arm 30 swings (idles) about the support shaft 24 in accordance with the profile of the first cam 13. Herein, the dashed-line arrows indicated in the FIGS. 5B and 5C mean idling.

Figure 5F:
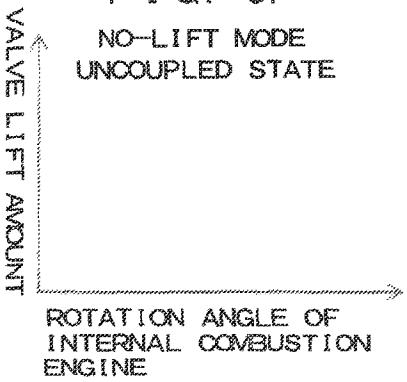
FIG. 5F is a graph illustrating a lift curve in the no-lift mode.

By adjusting the oil pressure of the hydraulic system to a low pressure as depicted in FIG. 4C, the first switch pin 51 is placed in the first uncoupled position Q1 on the inner side in the arm-width direction, and the second switch pin 61 is also placed in the second uncoupled position Q2 on the inner side in the arm-width direction. The "low pressure" herein means such an oil pressure that the force of oil pressure pressing the first switch pin 51 in the first pin hole 25 is smaller than the biasing force of the first spring 55 and that the force of oil pressure pressing the second switch pin 61 in the second pin hole 26 is also smaller than the biasing force of the second spring 65. By this adjustment, as depicted in FIGS. 5C and 5F and FIG. 8, the drive state is switched into a no-lift mode (uncoupled state) in which the main arm 20 does not swing. At this time, the lost motion spring 39 biases the first sub arm 30 toward the first cam 13 and, in phases including at least the base circle phase, biases the second sub arm 40 toward the second cams 14 via the first sub arm 30. Thus, the first sub arm 30 swings (idles) about the support shaft 24 in accordance with the profile of the first cam 13, and the second sub arm 40 also swings (idles) about the support shaft 24.

According to the first embodiment, the following effects can be obtained.

[A] As depicted FIG. 2, etc., both first and second switch pins 51 and 61 are arranged so as to be displaced from each other in positions where these switch pins do not overlap in side view seen in the arm-width direction. Unlike the conventional example (FIG. 11, FIGS. 12A and 12B) in which both switch pins 95 and 96 are aligned in the arm-width direction during the base circle phase, this arrangement eliminates the constraint of positional relations that the first sub arm 30 needs to be provided on the one side in the arm-width direction with respect to the main arm 20, and the second sub arm 40 needs to be provided on the other side in the arm-width direction. Thus, the flexibility of positional relations among the three arms 20, 30, and 40 can be increased.

[B] As depicted in FIG. 1, etc., the first sub arm 30 and the second sub arm 40 are arranged so as to be vertically displaced from each other in positions where these sub arms overlap in plan view. Thus, compared with the case in which the three arms 20, 30, and 40 are aligned in the arm-width direction, the sizes of the three arms 20, 30, and 40 can be reduced in the arm-width direction.

Figure 11:
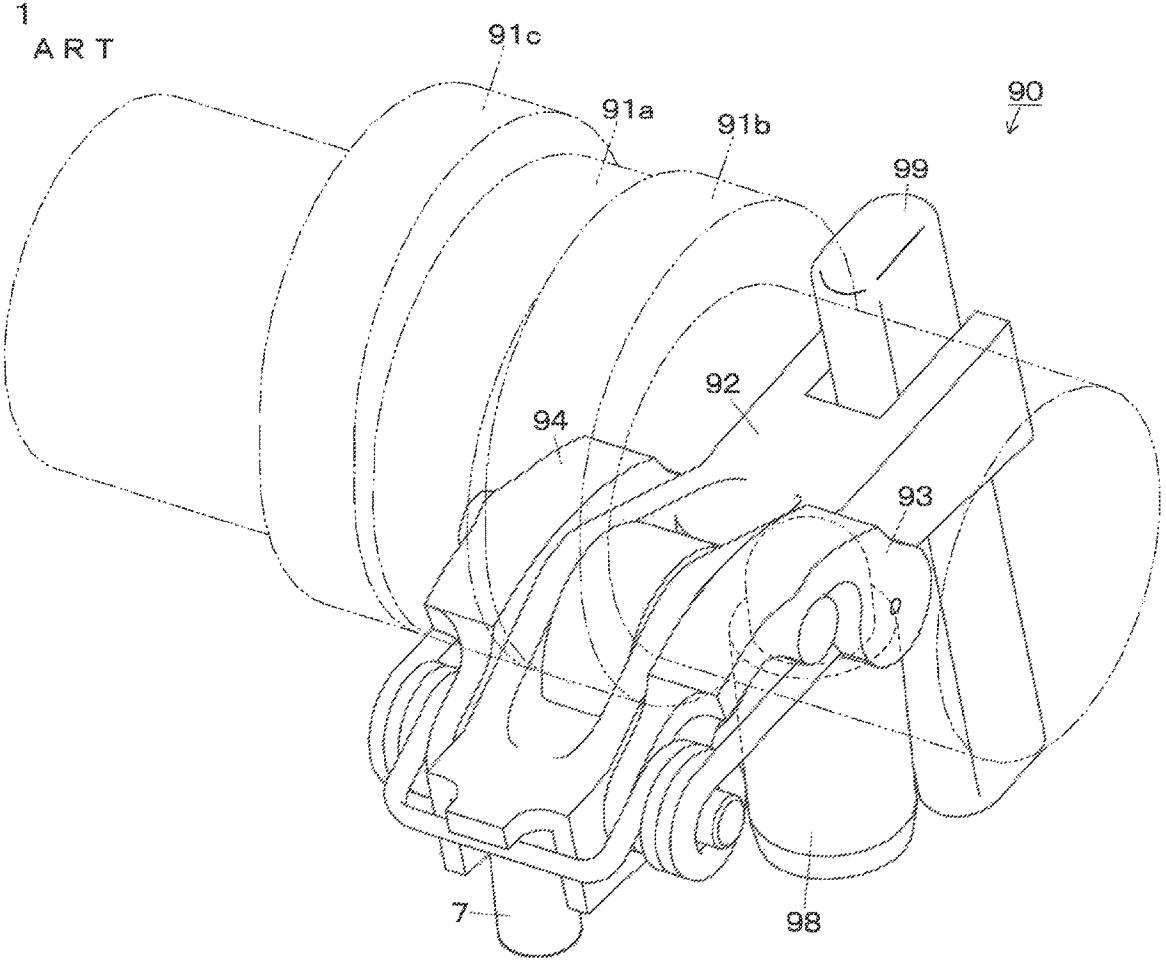
FIG. 11 PRIOR ART
FIG. 11 is a perspective view illustrating a variable valve mechanism of a conventional example.
Figure 12B:
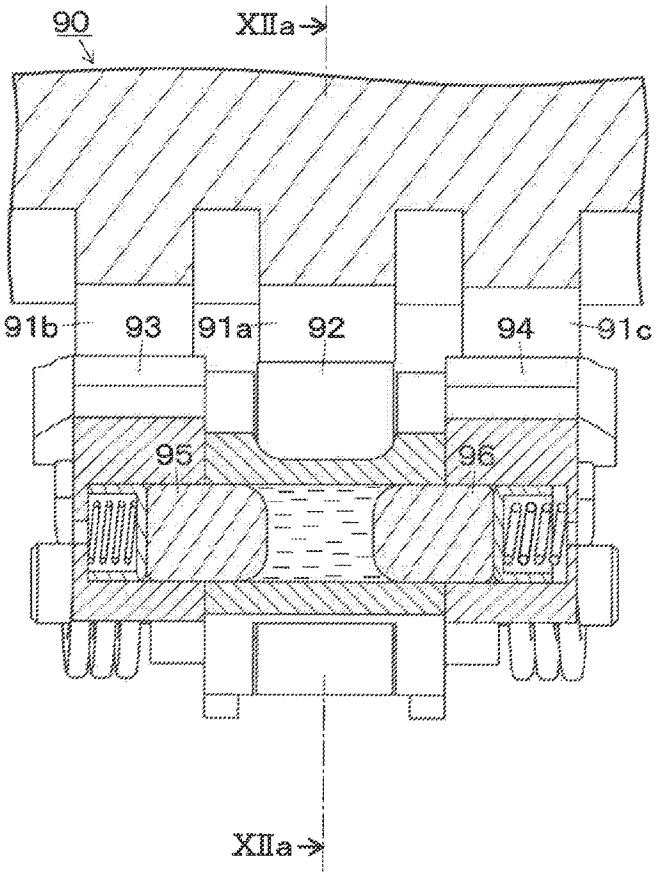
FIG. 12B PRIOR ART
FIG. 12B is a rear sectional view thereof.
Figure 12A:
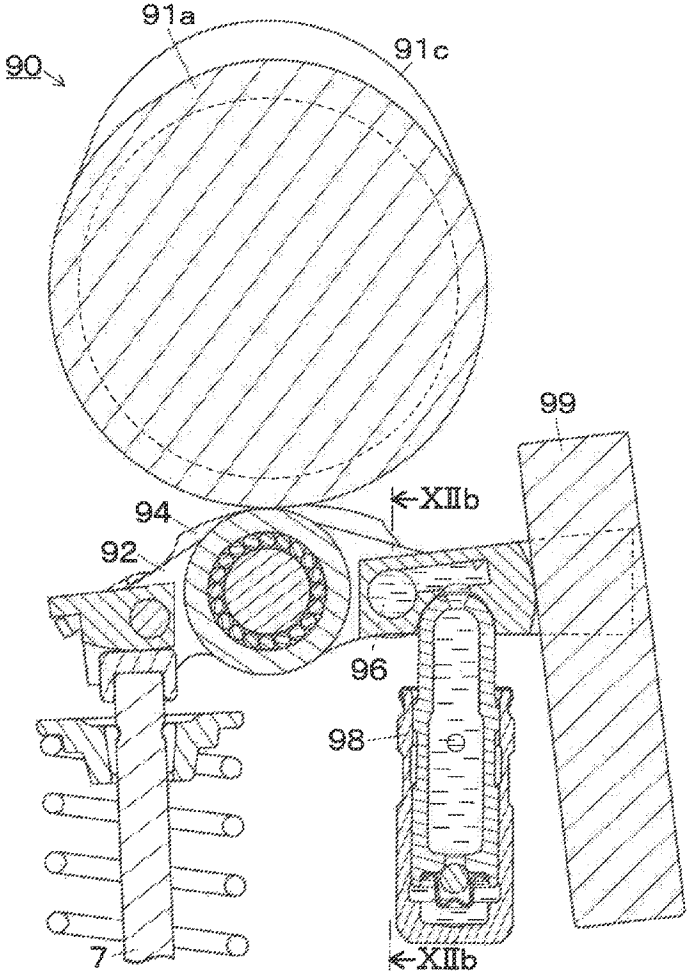
FIG. 12A PRIOR ART
FIG. 12A is a side sectional view of the conventional variable valve mechanism.

[C] As depicted in FIG. 1, etc., the first sub arm 30 and the second sub arm 40 can be used as outer arms, whereby the balance of the three arms 20, 30, and 40 in the arm-width direction can be improved. Thus, in all drive states (the both-sides-coupled state, the one-side-coupled state, the uncoupled state) depicted in FIGS. 5A, 5B, 5C, etc., the three arms 20, 30, and 40 can receive load evenly in the arm-width direction. This eliminates the need of a separate guide member such as the swing guide 99 described in the conventional example (FIG. 11, FIG. 12A).

Second Embodiment

Figure 9A:
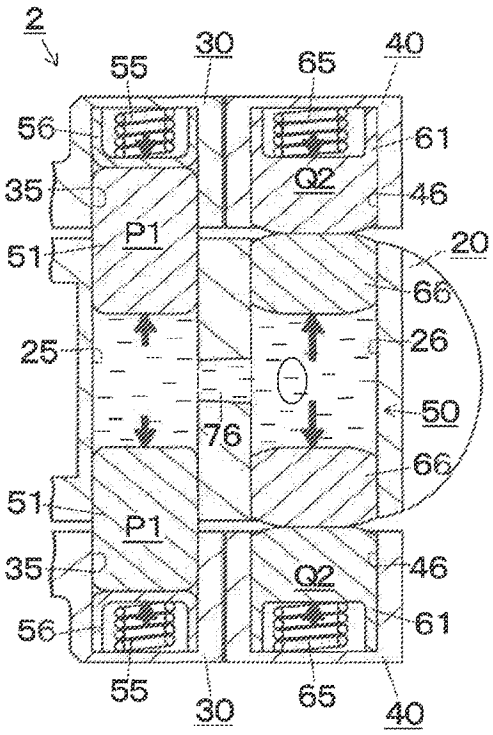
FIG. 9A is a sectional view illustrating a state of a variable valve mechanism of a second embodiment in the base circle phase that is switched into a large-lift mode (first one-side-coupled state)
Figure 9B:
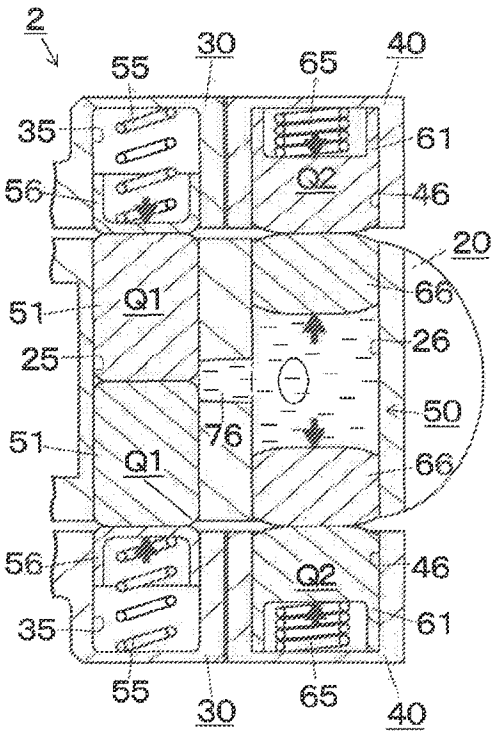
FIG. 9B is a sectional view illustrating the state that is switched into a no-lift mode (uncoupled state)
Figure 9C:
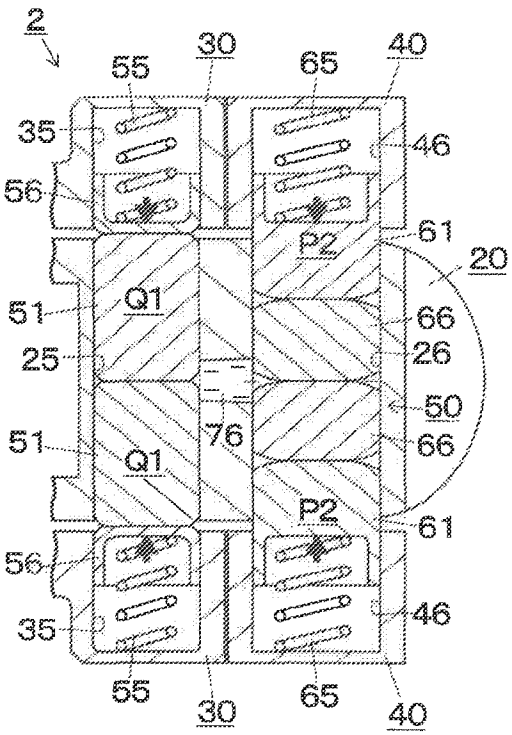
FIG. 9C is a sectional view illustrating the state that is switched into a small-lift mode (second one-side-coupled state)

A variable valve mechanism 2 of a second embodiment illustrated in FIGS. 9A to 9C is different from that of the first embodiment in the following points, and is the same in the other points. The positions of the second switch pin 61 and the second intervening pin 66 are exchanged. Thus, the second switch pin 61 is located on the relatively outer side in the arm-width direction, and the second intervening pin 66 is located on the relatively inner side in the arm-width direction. The second uncoupled position Q2 is not a position where the second switch pin 61 is withdrawn in the second pin hole 26 of the main arm, but is a position where the second switch pin 61 is withdrawn in the pin hole 46 of the second sub arm. Thus, the second uncoupled position Q2 is located on the relatively outer side in the arm-width direction, and the second coupled position P2 is located on the relatively inner side in the arm-width direction. The second spring 65 is in direct contact with the second switch pin 61, and biases this pin toward the second coupled position P2 on the inner side in the arm-width direction. The oil pressure in the second pin hole 26 of the main arm presses the second switch pin 61 toward the second uncoupled position Q2 on the outer side in the arm-width direction via the second intervening pin 66. The lost motion spring 39 does not bias the second sub arm 40 toward the second cams 14 via the first sub arm 30, and instead, a second lost motion spring (not depicted) that biases the second sub arm 40 toward the second cams 14 is provided.

By adjusting the oil pressure of the hydraulic system to the high pressure as depicted in FIG. 9A, the first switch pin 51 is placed in the first coupled position P1 on the outer side in the arm-width direction, and the second switch pin 61 is placed in the second uncoupled position Q2 also on the outer side in the arm-width direction. By this adjustment, the drive state is switched into a large-lift mode (first one-side-coupled state) in which the main arm 20 and the first sub arm 30 swing in accordance with the profile of the first cam 13 (large-lift cam) to drive the valve 7.

By adjusting the oil pressure of the hydraulic system to the intermediate pressure as depicted in FIG. 9B, the first switch pin 51 is placed in the first uncoupled position Q1 on the inner side in the arm-width direction, and the second switch pin 61 is placed in the second uncoupled position Q2 on the outer side in the arm-width direction. By this adjustment, the drive state is switched into the no-lift mode (uncoupled state) in which the main arm 20 does not swing.

By adjusting the oil pressure of the hydraulic system to the low pressure as depicted in FIG. 9C, the first switch pin 51 is placed in the first uncoupled position Q1 on the inner side in the arm-width direction, and the second switch pin 61 is placed in the second coupled position P2 also on the inner side in the arm-width direction. By this adjustment, the drive state is switched into a small-lift mode (second one-side-coupled state) in which the main arm 20 and the second sub arm 40 swing in accordance with the profile of the second cams 14 (small-lift cams) to drive the valve 7.

According to the second embodiment, in addition to the effects described above in [A] to [C], the following effect [D] can be obtained.

[D] In the small-lift mode, the first sub arm 30 is uncoupled from the main arm 20, and thus a design can be developed in which the profile (lift curve) of the second cams 14 (small-lift cams) intersects with the profile (lift curve) of the first cam 13 (large-lift cam).

Third Embodiment

Figure 10C:
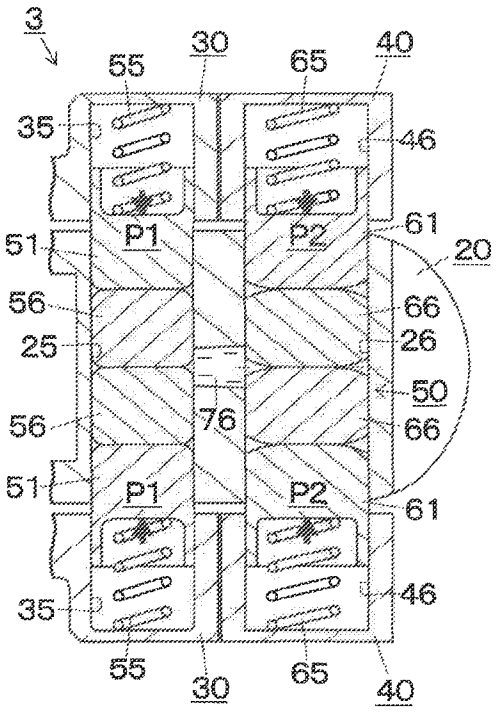
FIG. 10C is a sectional view illustrating the state that is switched into a large-lift mode (both-sides-coupled state)
Figure 10B:
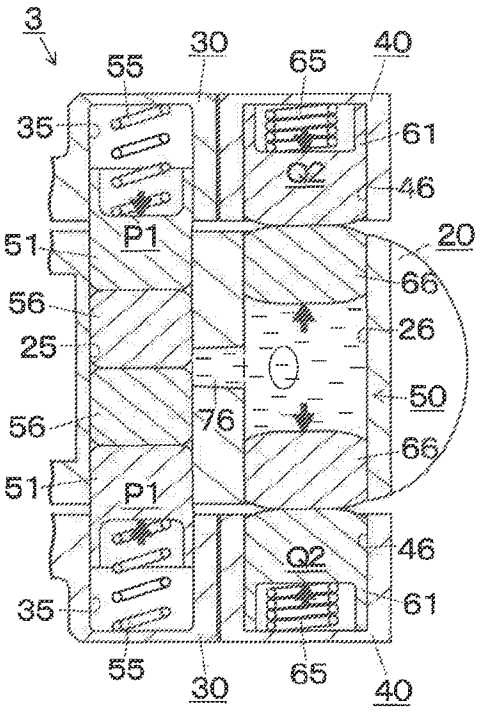
FIG. 10B is a sectional view illustrating the state that is switched into a small-lift mode (one-side-coupled state)
Figure 10A:
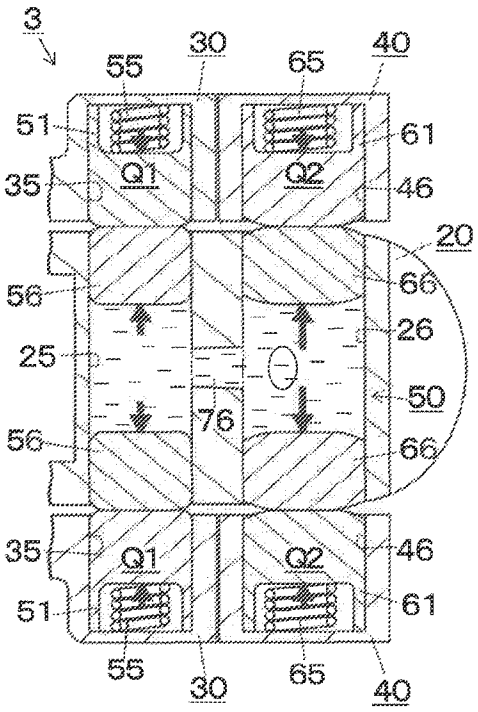
FIG. 10A is a sectional view illustrating a state of a variable valve mechanism of a third embodiment in the base circle phase that is switched into a no-lift mode (uncoupled state)

A variable valve mechanism 3 of a third embodiment illustrated in FIGS. 10A to 10C is different from that of the second embodiment in the following points, and is the same in the other points. The first cam is a small-lift cam, and the second cams are large-lift cams. The positions of the first switch pin 51 and the first intervening pin 56 are exchanged. Thus, the first switch pin 51 is located on the relatively outer side in the arm-width direction, and the first intervening pin 56 is located on the inner side in the arm-width direction. The first uncoupled position Q1 is not a position where the first switch pin 51 is withdrawn in the first pin hole 25 of the main arm, but is a position where the first switch pin is withdrawn in the pin hole 35 of the first sub arm. Thus, the first uncoupled position Q1 is located on the relatively outer side in the arm-width direction, and the first coupled position P1 is located on the relatively inner side in the arm-width direction. The first spring 55 is in direct contact with the first switch pin 51, and biases this pin toward the first coupled position P1 on the inner side in the arm-width direction. The oil pressure in the first pin hole 25 of the main arm presses the first switch pin 51 toward the first uncoupled position Q1 on the outer side in the arm-width direction via the first intervening pin 56.

By adjusting the oil pressure of the hydraulic system to the high pressure as depicted in FIG. 10A, the first switch pin 51 is placed in the first uncoupled position Q1 on the outer side in the arm-width direction, and the second switch pin 61 is placed in the second uncoupled position Q2 also on the outer side in the arm-width direction. By this adjustment, the drive state is switched into the no-lift mode (uncoupled state) in which the main arm 20 does not swing.

By adjusting the oil pressure of the hydraulic system to the intermediate pressure as depicted in FIG. 10B, the first switch pin 51 is placed in the first coupled position P1 on the inner side in the arm-width direction, and the second switch pin 61 is placed in the second uncoupled position Q2 on the outer side in the arm-width direction. By this adjustment, the drive state is switched into the small-lift mode (one-side-coupled state) in which the main arm 20 and the first sub arm 30 swing in accordance with the profile of the first cam (small-lift cam) to drive the valve 7.

By adjusting the oil pressure of the hydraulic system to the low pressure as depicted in FIG. 10C, the first switch pin 51 is placed in the first coupled position P1 on the inner side in the arm-width direction, and the second switch pin 61 is also placed in the second coupled position P2 on the inner side in the arm-width direction. By this adjustment, the drive state is switched into the large-lift mode (both-sides-coupled state) in which the three arms 20, 30, and 40 swing in accordance with the profile of the second cams (large-lift cams) to drive the valve 7.

According to the third embodiment also, the effects described above in [A] to [C] can be obtained.

The first to third embodiments may be modified, for example, as follows.

Modified Example 1

The diameter (the area of the end surface) of the first switch pin 51 may be the same as that of the second switch pin 61, and instead, the spring constant of the first spring 55 may be larger than the spring constant of the second spring 65.

Modified Example 2

The pivot 9 may be replaced with a pivot that automatically adjusts valve clearance to zero (e.g., hydraulic lash adjuster).

Modified Example 3

A third cam having a lift amount and an action angle that are smaller than those of the small-lift cams (the second cams 14 of the first and second embodiments, the first cam of the third embodiment) may be formed on the camshaft 10.

The main arm 20 may be provided with a slipper that is in sliding-contact with this third cam.

REFERENCE SIGNS LIST

1 Variable valve mechanism (first embodiment)
2 Variable valve mechanism (second embodiment)
3 Variable valve mechanism (third embodiment)
13 First cam
13*a* Base circle of first cam
14 Second cam
14*a* Base circle of second cam
20 Main arm
23 Elongated hole
29 Space
30 First sub arm
31 One-side portion of first sub arm
32 Other-side portion of first sub arm
33 Roller shaft
34 Roller
39 Lost motion spring
40 Second sub arm
41 One-side portion of second sub arm
42 Other-side portion of second sub arm
50 Switch device
51 First switch pin
55 First spring
61 Second switch pin
65 Second spring
71 Hydraulic mechanism
P1 First coupled position
P2 Second coupled position
Q1 First uncoupled position
Q2 Second uncoupled position
R Swing axis of main arm
M Area between swing axis and roller

The invention claimed is:

1. A variable valve mechanism of an internal combustion engine comprising:

a first cam and a second cam that have different profiles;

a main arm that drives a valve when swinging;

a first sub arm that swings when pressed by the first cam;

a second sub arm that swings when pressed by the second cam; and a switch device, wherein the switch device includes:

a first switch pin that is provided so as to be movable between a first coupled position where the first switch pin extends across an interface between the main arm and the first sub arm and a first uncoupled position where the first switch in does not extend across this interface; and a second switch pin that is provided so as to be movable between a second coupled position where the second switch pin extends across an interface between the main arm and the second sub arm and a second uncoupled position where the second switch pin does not extend across this interface, and in a side view when seen in an arm-width direction that is a longitudinal direction of a swing axis of the main arm, both switch pins are arranged so as to be displaced from each other in positions where these switch pins do not overlap at least during a base circle phase in which base circles of both cams act, wherein the first sub arm includes a roller rotatably mounted on the first sub arm and configured to be pressed by the first cam, and one of the switch pins is arranged such that at least part of the one of the switch pins is positioned in an area between the swing axis of the main arm and the roller in side view at least during the base circle phase, and the other of the switch pins is arranged such that a whole part of the other of the switch pins is positioned above the swing axis of the main arm in side view at least during the base circle phase.

2. The variable valve mechanism of the internal combustion engine according to claim 1, wherein the switch device includes:

a hydraulic mechanism that presses both switch pins with oil pressure of one hydraulic system;

a first spring that biases the first switch pin in a direction opposite to a pressing direction of the oil pressure; and a second spring that biases the second switch pin in the direction opposite to the pressing direction of the oil pressure, and the hydraulic mechanism switches a drive state of the valve into a first state by adjusting the oil pressure to a high pressure with which a force pressing the first switch pin becomes greater than a biasing force of the first spring and a force pressing the second switch pin becomes greater than a biasing force of the second spring, switches the drive state of the valve into a second state by adjusting the oil pressure to an intermediate pressure with which the force pressing the first switch pin becomes smaller than the biasing force of the first spring and the force pressing the second switch pin becomes greater than the biasing force of the second spring, and switches the drive state of the valve into a third state by adjusting the oil pressure to a low pressure with which the force pressing the first switch pin becomes smaller than the biasing force of the first spring and the force pressing the second switch pin becomes smaller than the biasing force of the second spring.

3. The variable valve mechanism of the internal combustion engine according to claim 2, wherein a spring constant of the first spring is larger than that of the second spring.

4. The variable valve mechanism of the internal combustion engine according to claim 2, wherein an area of the second switch pin that receives the oil pressure is larger than that of the first switch pin.

5. The variable valve mechanism of the internal combustion engine according to claim 1, wherein the switch device switches a drive state of the valve among a both-sides-coupled state in which the first switch pin is placed in the first coupled position and the second switch pin is placed in the second coupled position, a one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

6. The variable valve mechanism of the internal combustion engine according to claim 5, wherein the second sub arm is interposed between the first sub arm and the second cam, and the variable valve mechanism includes a lost motion spring that biases the first sub arm toward the first cam in the one-side-coupled state, and biases the first sub arm toward the first cam and also biases the second sub arm toward the second cam via the first sub arm in the uncoupled state.

7. The variable valve mechanism of the internal combustion engine according to claim 1, wherein the switch device switches a drive state of the valve among a first one-side-coupled state in which the first switch pin is placed in the first coupled position and the second switch pin is placed in the second uncoupled position, a second one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

8. A variable valve mechanism of an internal combustion engine comprising:

a first cam and a second cam that have different profiles;

a main arm that drives a valve when swinging;

a first sub arm that swings when pressed by the first cam;

a second sub arm that swings when pressed by the second cam; and a switch device, wherein the switch device includes:

a first switch pin that is provided so as to be movable between a first coupled position where the first switch pin extends across an interface between the main arm and the first sub arm and a first uncoupled position where the first switch pin does not extend across this interface; and a second switch pin that is provided so as to be movable between a second coupled position where the second switch pin extends across an interface between the main arm and the second sub arm and a second uncoupled position where the second switch pin does not extend across this interface, and in a side view when seen in an arm-width direction that is a longitudinal direction of a swing axis of the main arm, both switch pins are arranged so as to be displaced from each other in positions where these switch pins do not overlap at least during a base circle phase in which base circles of both cams act, wherein the first sub arm and the second sub arm are arranged so as to be vertically displaced from each other in positions where these sub arms overlap in plan view at least during the base circle phase.

9. The variable valve mechanism of the internal combustion engine according to claim 8, wherein the switch device includes:

a hydraulic mechanism that presses both switch pins with oil pressure of one hydraulic system;

a first spring that biases the first switch pin in a direction opposite to a pressing direction of the oil pressure; and a second spring that biases the second switch pin in the direction opposite to the pressing direction of the oil pressure, and the hydraulic mechanism switches a drive state of the valve into a first state by adjusting the oil pressure to a high pressure with which a force pressing the first switch pin becomes greater than a biasing force of the first spring and a force pressing the second switch pin becomes greater than a biasing force of the second spring, switches the drive state of the valve into a second state by adjusting the oil pressure to an intermediate pressure with which the force pressing the first switch pin becomes smaller than the biasing force of the first spring and the force pressing the second switch pin becomes greater than the biasing force of the second spring, and switches the drive state of the valve into a third state by adjusting the oil pressure to a low pressure with which the force pressing the first switch pin becomes smaller than the biasing force of the first spring and the force pressing the second switch pin becomes smaller than the biasing force of the second spring.

10. The variable valve mechanism of the internal combustion engine according to claim 8, wherein the switch device switches a drive state of the valve among a both-sides-coupled state in which the first switch pin is placed in the first coupled position and the second switch pin is placed in the second coupled position, a one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

11. The variable valve mechanism of the internal combustion engine according to claim 8, wherein the switch device switches a drive state of the valve among a first one-side-coupled state in which the first switch pin is placed in the first coupled position and the second switch pin is placed in the second uncoupled position, a second one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

12. A variable valve mechanism of an internal combustion engine comprising:

a first cam and a second cam that have different profiles;

a main arm that drives a valve when swinging;

a first sub arm that swings when pressed by the first cam;

a second sub arm that swings when pressed by the second cam; and a switch device, wherein the switch device includes:

a first switch pin that is provided so as to be movable between a first coupled position where the first switch pin extends across an interface between the main arm and the first sub arm and a first uncoupled position where the first switch pin does not extend across this interface; and a second switch pin that is provided so as to be movable between a second coupled position where the second switch pin extends across an interface between the main arm and the second sub arm and a second uncoupled position where the second switch pin does not extend across this interface, and in a side view when seen in an arm-width direction that is a longitudinal direction of a swing axis of the main arm, both switch pins are arranged so as to be displaced from each other in positions where these switch pins do not overlap at least during a base circle phase in which base circles of both cams act, wherein the main arm is swingably supported by a pivot, and the first sub arm and the second sub arm are outer arms each of which includes a one-side portion disposed on one side in the arm-width direction with respect to the main arm and an other-side portion disposed on the other side in the arm-width direction with respect to the main arm.

13. The variable valve mechanism of the internal combustion engine according to claim 12, wherein the switch device includes:

a hydraulic mechanism that presses both switch pins with oil pressure of one hydraulic system;

a first spring that biases the first switch pin in a direction opposite to a pressing direction of the oil pressure; and a second spring that biases the second switch pin in the direction opposite to the pressing direction of the oil pressure, and the hydraulic mechanism switches a drive state of the valve into a first state by adjusting the oil pressure to a high pressure with which a force pressing the first switch pin becomes greater than a biasing force of the first spring and a force pressing the second switch pin becomes greater than a biasing force of the second spring, switches the drive state of the valve into a second state by adjusting the oil pressure to an intermediate pressure with which the force pressing the first switch pin becomes smaller than the biasing force of the first spring and the force pressing the second switch pin becomes greater than the biasing force of the second spring, and switches the drive state of the valve into a third state by adjusting the oil pressure to a low pressure with which the force pressing the first switch pin becomes smaller than the biasing force of the first spring and the force pressing the second switch pin becomes smaller than the biasing force of the second spring.

14. The variable valve mechanism of the internal combustion engine according to claim 12, wherein the switch device switches a drive state of the valve among a both-sides-coupled state in which the first switch pin is placed in the first coupled position and the second switch pin is placed in the second coupled position, a one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

15. The variable valve mechanism of the internal combustion engine according to claim 12, wherein the switch device switches a drive state of the valve among a first one-side-coupled state in which the first switch pin is placed in the first coupled position and the second switch pin is placed in the second uncoupled position, a second one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

16. A variable valve mechanism of an internal combustion engine comprising:

a first cam and a second cam that have different profiles;

a main arm that drives a valve when swinging;

a first sub arm that swings when pressed by the first cam;

a second sub arm that swings when pressed by the second cam; and a switch device, wherein the switch device includes:

a first switch pin that is provided so as to be movable between a first coupled position where the first switch pin extends across an interface between the main arm and the first sub arm and a first uncoupled position where the first switch pin does not extend across this interface; and a second switch pin that is provided so as to be movable between a second coupled position where the second switch pin extends across an interface between the main arm and the second sub arm and a second uncoupled position where the second switch pin does not extend across this interface, and in a side view when seen in an arm-width direction that is a longitudinal direction of a swing axis of the main arm, both switch pins are arranged so as to be displaced from each other in positions where these switch pins do not overlap at least during a base circle phase in which base circles of both cams act, wherein the main arm has a space in its intermediate portion in the arm-width direction, and on each of side surfaces of the main arm on both sides in the arm-width direction, an elongated hole extending in a swing direction of the first sub arm with respect to the main arm is formed in a manner penetrating the main arm to reach the space, and the first sub arm includes:

a one-side portion that is disposed on one side in the arm-width direction with respect to the main arm;

an other-side portion that is disposed on the other side in the arm-width direction with respect to the main arm;

a roller shaft that passes through the elongated hole and the space of the main arm to extend from the one-side portion to the other-side portion; and a roller that is pivotally supported by a part of the roller shaft located in the space, the roller configured to be pressed by the first cam.

17. The variable valve mechanism of the internal combustion engine according to claim 16, wherein the switch device includes:

a hydraulic mechanism that presses both switch pins with oil pressure of one hydraulic system;

a first spring that biases the first switch pin in a direction opposite to a pressing direction of the oil pressure; and a second spring that biases the second switch pin in the direction opposite to the pressing direction of the oil pressure, and the hydraulic mechanism switches a drive state of the valve into a first state by adjusting the oil pressure to a high pressure with which a force pressing the first switch pin becomes greater than a biasing force of the first spring and a force pressing the second switch pin becomes greater than a biasing force of the second spring, switches the drive state of the valve into a second state by adjusting the oil pressure to an intermediate pressure with which the force pressing the first switch pin becomes smaller than the biasing force of the first spring and the force pressing the second switch pin becomes greater than the biasing force of the second spring, and switches the drive state of the valve into a third state by adjusting the oil pressure to a low pressure with which the force pressing the first switch pin becomes smaller than the biasing force of the first spring and the force pressing the second switch pin becomes smaller than the biasing force of the second spring.

18. The variable valve mechanism of the internal combustion engine according to claim 16, wherein the switch device switches a drive state of the valve among a both-sides-coupled state in which the first switch pin is placed in the first coupled position and the second switch pin is placed in the second coupled position, a one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

19. The variable valve mechanism of the internal combustion engine according to claim 16, wherein the switch device switches a drive state of the valve among a first one-side-coupled state in which the first switch pin is placed in the first coupled position and the second switch pin is placed in the second uncoupled position, a second one-side-coupled state in which the first switch pin is placed in the first uncoupled position and the second switch pin is placed in the second coupled position, and an uncoupled state in which the first switch pin is placed in the first uncoupled position and the second switch pin is placed in the second uncoupled position.

* * * * *